US009314654B2

(12) United States Patent
Grantham

(10) Patent No.: US 9,314,654 B2
(45) Date of Patent: Apr. 19, 2016

(54) GRANTHAM MECHANICAL VENTILATOR FOR USE IN PREVENTING FLASHOVER WHEN FIGHTING FIRES

(76) Inventor: Robert Grantham, Schnecksville, PA (US)

( * ) Notice: Subject to any disclaimer, the term of this patent is extended or adjusted under 35 U.S.C. 154(b) by 11 days.

(21) Appl. No.: 14/116,399

(22) PCT Filed: May 1, 2012

(86) PCT No.: PCT/IB2012/002613

§ 371 (c)(1), (2), (4) Date: Nov. 8, 2013

(87) PCT Pub. No.: WO2013/072759

PCT Pub. Date: May 23, 2013

(65) Prior Publication Data

US 2014/0326806 A1 Nov. 6, 2014

Related U.S. Application Data

(60) Provisional application No. 61/528,274, filed on Aug. 28, 2011.

(51) Int. Cl.

| | |
|---|---|
| ***A62C 31/05*** | (2006.01) |
| ***A62C 31/24*** | (2006.01) |
| ***A62C 31/07*** | (2006.01) |
| ***A62C 99/00*** | (2010.01) |
| ***B05B 15/06*** | (2006.01) |
| *A62B 5/00* | (2006.01) |

(52) U.S. Cl.

CPC ..... *A62C 31/24* (2013.01); *A62C 31/05* (2013.01); *A62C 31/07* (2013.01); *A62C 99/0072* (2013.01); *B05B 15/061* (2013.01); *A62B 5/00* (2013.01)

(58) Field of Classification Search

CPC ..... A62C 31/22; A62C 31/24
USPC ..... 239/271, 272; 169/70, 24, 91
See application file for complete search history.

(56) References Cited

U.S. PATENT DOCUMENTS

| | | | | |
|---|---|---|---|---|
| 2,265,063 | A * | 12/1941 | Crumly | 169/25 |
| 2,813,753 | A * | 11/1957 | Roberts | A62C 31/22 169/70 |
| 4,703,808 | A * | 11/1987 | O'Donnell | A62C 31/22 169/91 |
| 4,986,364 | A * | 1/1991 | Clark | A62C 3/00 169/37 |
| 5,839,664 | A * | 11/1998 | Relyea | 239/271 |
| 6,340,060 | B1 * | 1/2002 | Larsson et al. | 169/43 |
| 6,755,259 | B2 * | 6/2004 | Peltola et al. | 169/47 |
| 7,748,469 | B1 * | 7/2010 | Todman et al. | 169/70 |

* cited by examiner

*Primary Examiner* — Len Tran
*Assistant Examiner* — Tuongminh Pham

(57) ABSTRACT

Disclosed is a mechanical firefighting device optimized to limit injury to firefighting personnel and to minimize damage to property by suppressing flashover in a structural compartment fire by venting superheated gases and smoke from the compartment, as well facilitating the rapid emergency egress of firefighters from the compartment.

5 Claims, 9 Drawing Sheets

GRANTHAM MECHANICAL VENTILATOR FOR USE IN PREVENTING FLASHOVER WHEN FIGHTING FIRES

This utility patent application is being filed as a PCT application for consideration in all PCT member states, with the USPTO as the designated receiving office. The instant application claims priority from provisional application No. 61/528,274 filed in the USPTO on 26 Aug. 2011 whose entire contents are incorporated herein by reference.

FIELD OF THE INVENTION

This invention relates to an improved tool and methods for its use by firefighters in minimizing the loss of human life and damage to property resulting from the phenomenon known to firefighters as "flashover."

BRIEF SUMMARY OF THE INVENTION

Disclosed is a novel defensive firefighting tool which reduces the possibility of flashover. The Grantham Mechanical Ventilator reduces injury to humans at the scene as well as reducing property damage, by (1) pulling superheated air and smoke from the burning structure and (2) optionally by dousing the flames directly with a sprinkler flow when appropriate. Additionally, the tool (3) reduces the spread of fire within the burning structure, (4) reduces the spread of fire to adjacent flammable exposures, and (5) facilitates escape by people trapped inside the burning structure. Finally, (6) once put in place the tool provides an unmanned means by which the preceding may be accomplished.

DETAILED DESCRIPTION OF THE INVENTION

Figure 1:
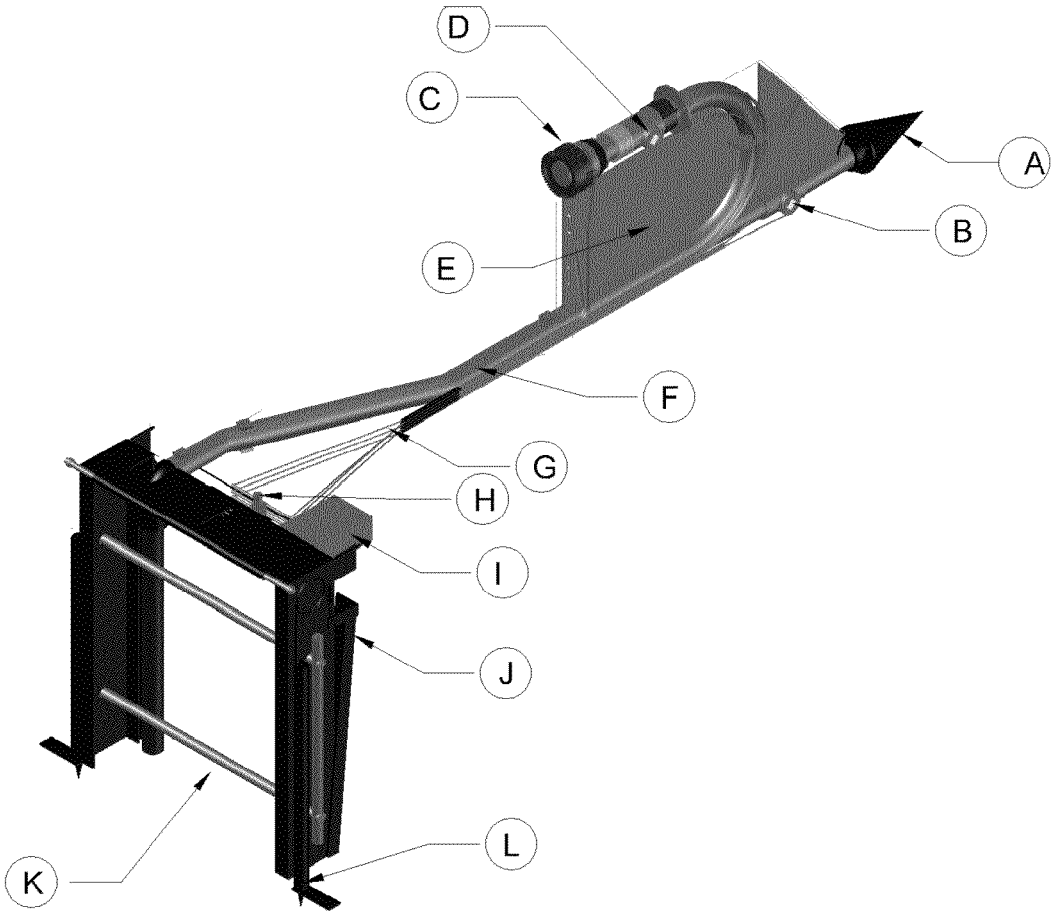
FIG. 1: Top right-rear view of internal structure and ladder mounting mechanism.

As one skilled in the art of firefighting knows, flashover is the most dangerous time of a fire. When the contents of a burning room burst into flame simultaneously, flashover has occurred. Flashover is caused by the radiation feedback of heat. Heat from the growing fire is absorbed into the upper walls and contents of the room, heating up the combustible gases and furnishings to their auto-ignition temperature. This buildup of heat in the room triggers flashover, which signals: (a) the end of an effective search and rescue in a room; (b) the imminent death of any person, civilian or firefighter, trapped in the blazing room; (c) the end of being able to use a portable fire extinguisher, instead requiring an fire hose attached to a source of pressurized water; (d) the end of the fire's growth stage and that the fire is in the second stage of combustion—the fully developed stage; and finally, (e) the change from a contents fire to a structure fire.

Flashover is not consistently time-dependent. Some flashovers can occur within three minutes from ignition; others may take considerably longer. Flashover times are more dependent on the size of the compartment, the fuel load within the compartment, and the construction of the compartment. Again, these variables cannot be seen from outside the structure, so the interior firefighters and officers have to be constantly aware of them.

Flashover signals the beginning of the structural collapse danger. When operating at a fire, firefighters want to delay flashover inside a burning room. By delaying flashover you can "buy" several minutes which may be critical. For example, you may want to delay flashover to make a search and rescue of the burning room or to allow a firefighter to go to a room above or next-to the fire to rescue a trapped victim. Or, you may want to delay flashover to gain several minutes when there is a delay in the placement of the first fire hose.

The first tactic that can delay a flashover is to ventilate the compartment. This allows heat and heated gases to escape from the compartment, replacing them with cooler air at a rate faster than the heat and gases replenished by the combustion taking place. Ventilation serves to delay flashover when done quickly and effectively.

The second tactic that can delay a flashover is to close off the compartment. By closing a door in the room that is experiencing pre-flashover conditions, air cannot enter as readily. This can decrease the rate of burning in the room, delaying the flashover. By closing a door, you are also taking the imminent flashover out of the surrounding area so that other nearby rooms can be searched in a safer manner for a longer time.

The final way that a flashover can be delayed is by cooling the atmosphere with water, high in the compartment. This would have to be done with a fire hose or water-based fire extinguisher. By aiming the stream of water into the high heat layer, the gases are cooled. This reduction in temperature slows the process of flashover within the compartment. This technique has the disadvantage of causing an increase in steam buildup that can hinder vision within the burning compartment.

The indications of a potential flashover may include a growth stage fire that produces thick and dark smoke, high heat buildup, and rollover. A growth stage fire must exist, even though it may be partially or completely obscured by walls, furniture, and thick smoke. This is the only way the heat needed to flashover can be produced within a compartment. Thick and dark smoke indicates the fuels that are present are giving off vapors that can burn when exposed to high heat. The heat is intense and can build up quickly.

Heat: When heat mixes with smoke, it forces a firefighter to crouch down on hands and knees to enter a room to perform search and rescue. This must be considered a warning sign that flashover may occur, as heat is the triggering variable for flashover. If the heat in the smoke filled room causes firefighters to crouch down near the floor, flashover may be imminent.

Rollover: Rollover is the ignition of the accumulated gases that have collected at ceiling level. This may start off as a sporadic burst of orange flames and build up in frequency and intensity to a "sea" of orange flames overhead. Again, this may be partially obstructed by the smoke, but it can usually be seen by those who look for it. The intense rollover condition, characterized by the sea of orange overhead, is usually considered a late sign of an impending flashover.

Protective Equipment: With all of the advancements in today's firefighter's personal protective equipment, it is still not designed to withstand flashover conditions for longer than just a few seconds. A few seconds may save a firefighter's life if he or she takes fast and appropriate action, but the gear will fail quickly when exposed to the temperatures commonly found in flashover conditions, between 1,000° F. and 1,500° F.

Taking a proactive approach: Rather than send firefighting personnel into a burning structure to assess whether flashover is imminent, the instant invention allows the conditioning of the environment in the compartment being entered to reduce the chances of flashover by removing built-up heat and smoke prior to entry, as well as allowing the dousing of the flames with water when appropriate. An additional benefit of removing smoke buildup is increased visibility, allowing a more accurate assessment of the situation therein, further increasing the safety factor. Additionally, the Grantham Mechanical Ventilator requires neither that a firefighter enter the burning building to put it in position nor remain in the building to operate it, thereby further decreasing the risk to firefighters.

Using the Grantham Mechanical Ventilator: The Officer of the first arriving fire engine, after confirming that all humans are out of the burning structure by a complete evaluation of the scene, determines the point of origin of the fire and to help reduce dangers to his or her crew, orders that the Grantham Mechanical Ventilator to be used in the compartment that is the point of origin of the fire. The tool is then secured to the top of a ladder with the fire hose connected to the device's water input and positioned through the opening into the burning structure so that the sprayer circuit input is outside the structure and fog sprayer output nozzle is inside the structure pointing outward. If the attic compartment is the only area needing emergency ventilation, then an opening large enough to allow fog pattern effectiveness must be made before inserting the mechanical ventilator. A firefighter then (1) climbs the ladder and clears away the remaining glass and debris from the window frame, (2) signals to the pump operator to turn on the water, (3) activates the tool's sprinkler for five to 10 seconds if appropriate, then (4) adjusts the water flow outward from the ventilating fog nozzle to optimize it for the size of the window opening through which it is inserted. Once configured, the device requires no further attention. Note that a preferred embodiment of the instant invention can apply water spray to suppress a fire, but the tool may also be configured to apply foam or other fire suppression materials as well.

How it works: In essence, the cool water fog stream pulls the heat and smoke from the burning compartment in a manner akin the way one racing car "drafts" another, with the front car creating a partial vacuum which in effect pulls the following car along. In this case, the fog stream is analogous to the lead car and the hot air/smoke mixture is the following car. In addition, the fog, being much cooler than the heated air in the compartment and in a high state of division as tiny droplets, presents a highly effective heat sink into which the heat flows due to basic thermodynamic principals.

In the Grantham Mechanical Ventilator, the distance from the outlet of the fog nozzle to the opening in the side of the burning building can vary. In a preferred embodiment, the distance is three feet.

Protecting adjacent exposures from flashover: The Grantham Mechanical Ventilator, by suppressing flashover, protects adjacent exposures (combustible materials) located near the burning building by suppressing the ejectment of flames and radiant heat from the burning structure that typically occurs during flashover. Additionally, the fog serves to douse any incipient combustion by cooling and dampening any nearby adjacent exposures.

In another preferred embodiment, the Grantham Mechanical Ventilator will possess a forcible-entry mechanism.

DETAILED DESCRIPTION OF THE FIGURES

Figure 2:
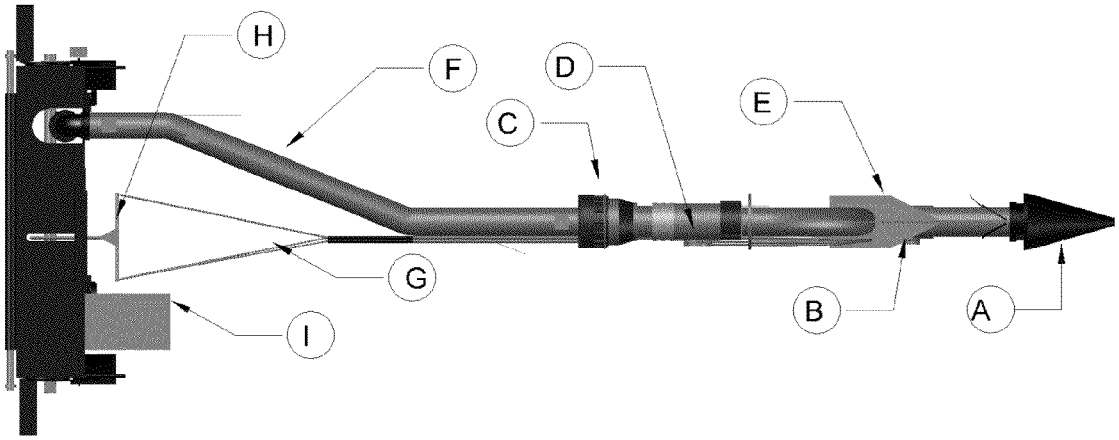
FIG. 2: Top view of internal structure and ladder mounting mechanism.

FIG. 1—View from Top Right Rear
- A. ENTRY TIP NOZZLE
- B. ENTRY NOZZLE CONTROL PULLEY
- C. FOG NOZZLE
- D. FOG NOZZLE CONTROL PULLEY
- E. PIPE/BODY SUPPORT PLATES
- F. WATER SUPPLY PIPE
- G. CONTROL CABLES
- H. CONTROL LEVERS
- I. ELECTRIC POWER SUPPLY (12 VDC)
- J. IMPACT RESISTANT PLATES
- K. LADDER RUNG SUPPORT BAR
- L. FIRST FLOOR TELESCOPIC GROUND ANCHOR WITH FOOTPLATE FIG. 2—Top View
- A. ENTRY TIP NOZZLE
- B. ENTRY NOZZLE CONTROL PULLEY
- C. FOG NOZZLE
- D. FOG NOZZLE CONTROL PULLEY
- E. PIPE/BODY SUPPORT PLATES
- F. WATER SUPPLY PIPE
- G. CONTROL CABLES
- H. CONTROL LEVERS
- I. ELECTRIC POWER SUPPLY (12 VDC)

Figure 3:
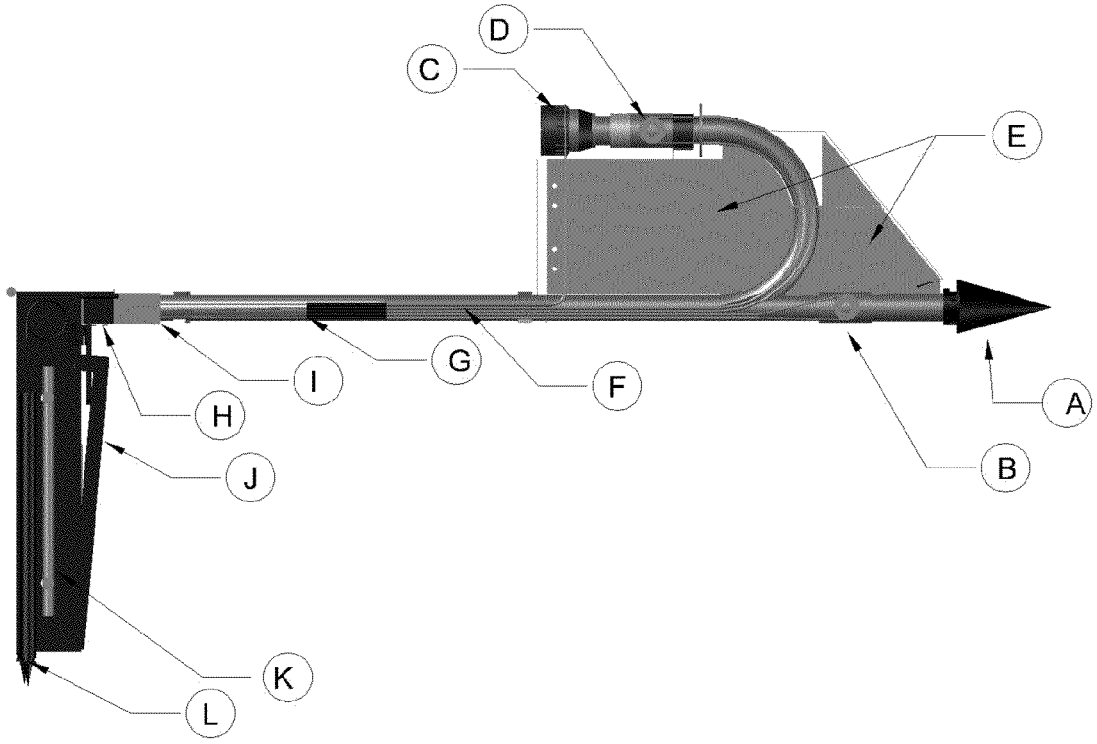
FIG. 3: Right side view of internal structure and ladder mounting mechanism.
Figure 4:
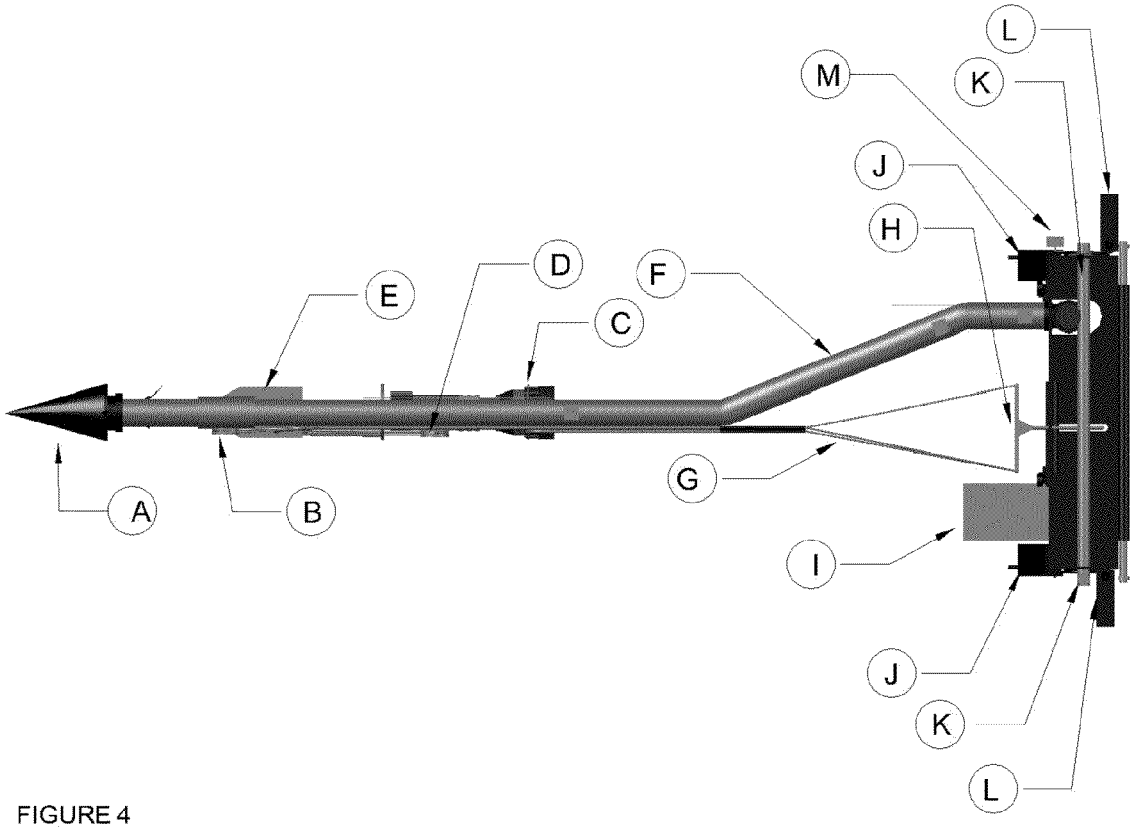
FIG. 4: Bottom view of internal structure and ladder mounting mechanism.
Figure 5:
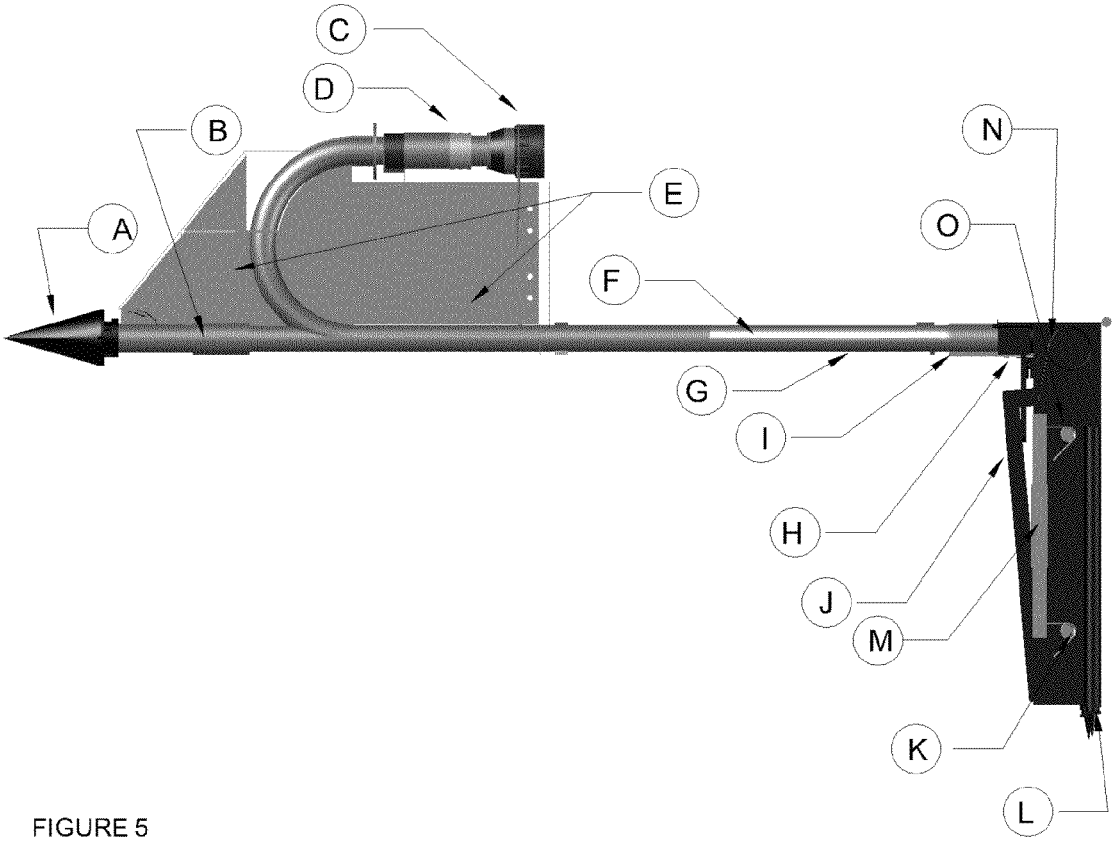
FIG. 5: Left side view of internal structure and ladder mounting mechanism.
Figure 6:
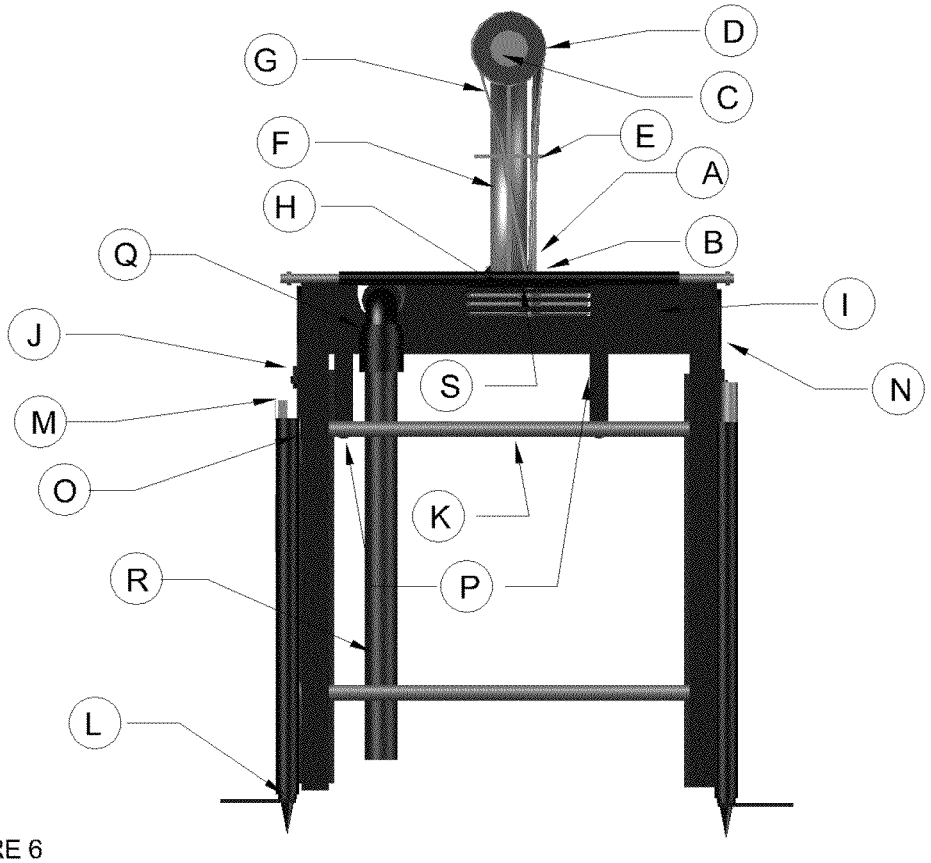
FIG. 6: Rear view of internal structure and ladder mount mechanism.
Figure 7:
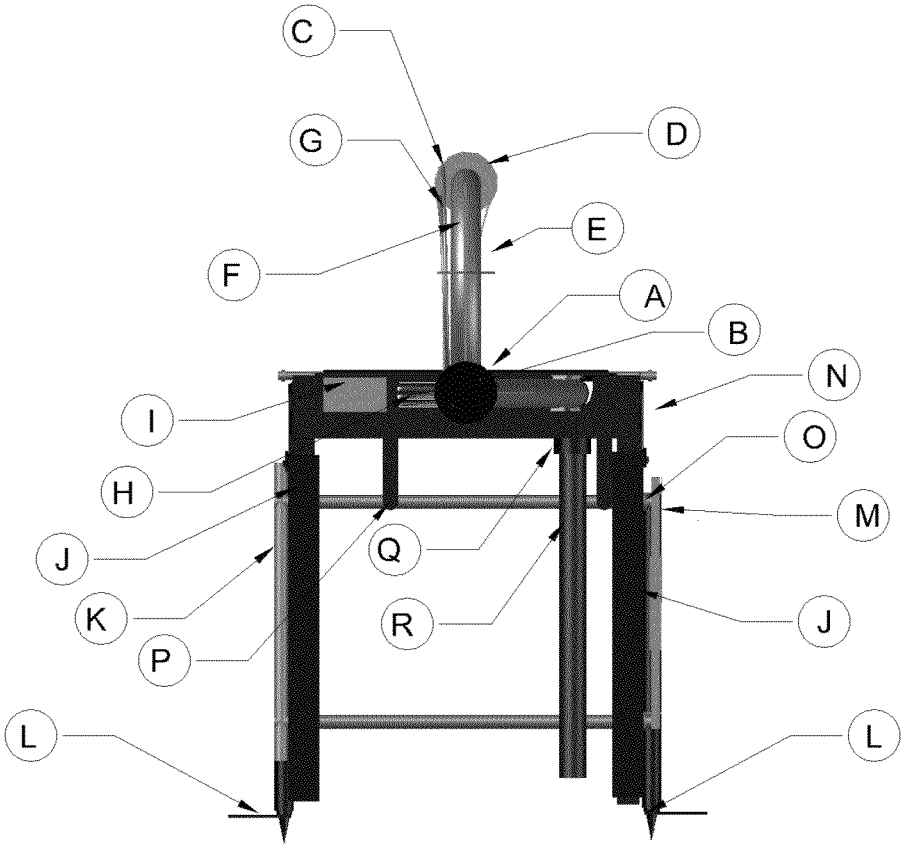
FIG. 7: Front view of internal structure and ladder mount mechanism.
Figure 8:
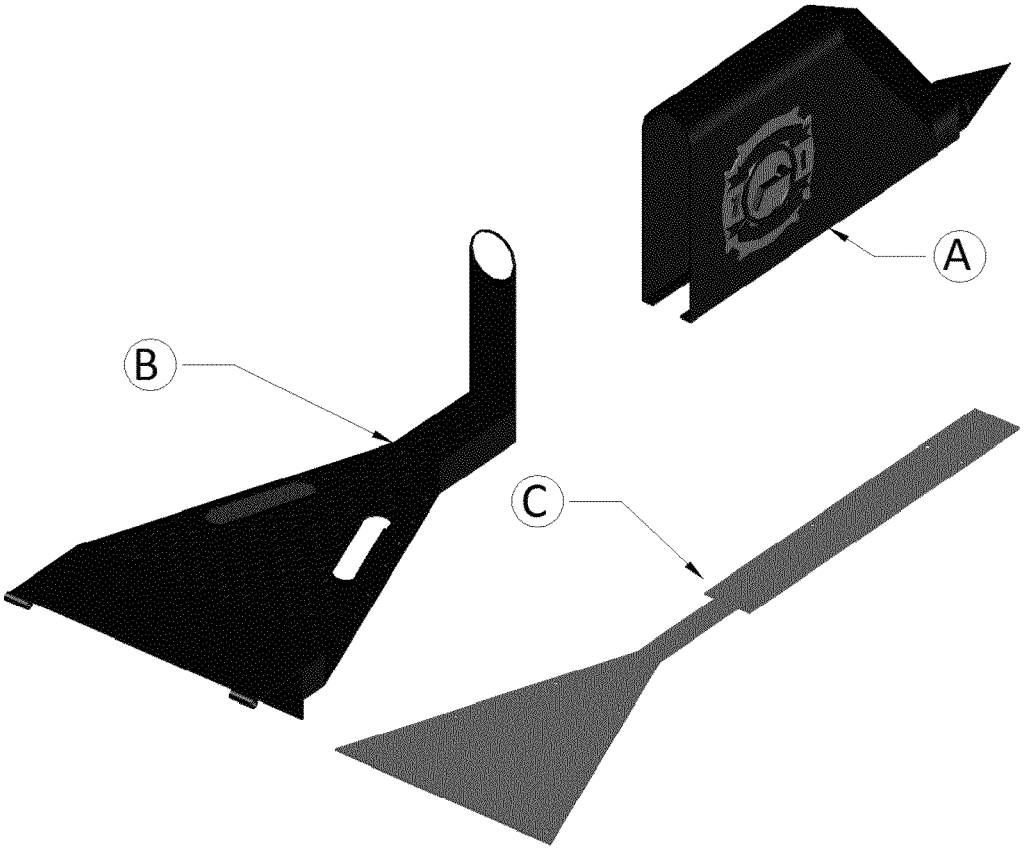
FIG. 8: External body structures.
Figure 9:
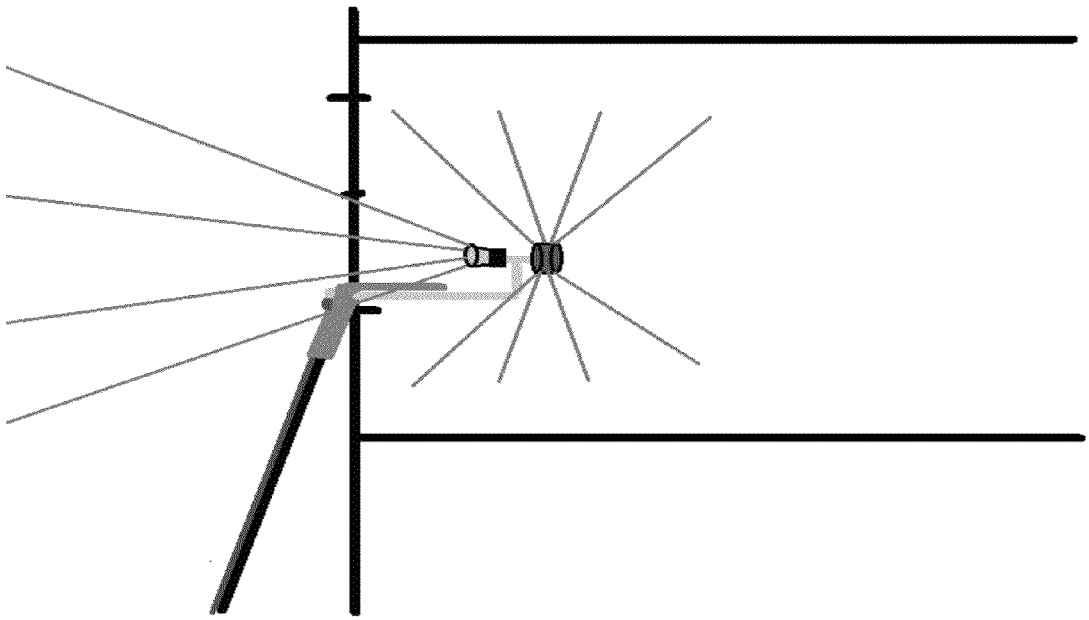
FIG. 9: Graphic depiction of Grantham Mechanical Ventilator in use.

FIG. 3—Left Side View
- A. ENTRY TIP NOZZLE
- B. ENTRY NOZZLE CONTROL PULLEY
- C. FOG NOZZLE
- D. FOG NOZZLE CONTROL PULLEY
- E. PIPE/BODY SUPPORT PLATES
- F. WATER SUPPLY PIPE
- G. CONTROL CABLES
- H. CONTROL LEVERS
- I. ELECTRIC POWER SUPPLY (12 VDC)
- J. IMPACT RESISTANT PLATES
- K. LADDER RUNG SUPPORT BAR
- L. FIRST FLOOR TELESCOPIC GROUND ANCHOR. WITH FOOTPLATE FIG. 4—Bottom View
- A. ENTRY TIP NOZZLE
- B. ENTRY NOZZLE CONTROL PULLEY
- C. FOG NOZZLE
- D. FOG NOZZLE CONTROL PULLEY
- E. PIPE/BODY SUPPORT PLATES
- F. WATER SUPPLY PIPE
- G. CONTROL CABLES
- H. CONTROL LEVERS
- I. ELECTRIC POWER SUPPLY (12 VDC)
- J. IMPACT RESISTANT PLATES
- K. LADDER RUNG SUPPORT BAR
- L. FIRST FLOOR TELESCOPIC GROUND ANCHOR WITH FOOTPLATE
- M. LADDER RUNG SUPPORT BAR RELEASE HANDLE FIG. 5—Right Side View
- A. ENTRY TIP NOZZLE
- B. ENTRY NOZZLE CONTROL PULLEY
- C. FOG NOZZLE
- D. FOG NOZZLE CONTROL PULLEY
- E. PIPE/BODY SUPPORT PLATES F. WATER SUPPLY PIPE
G. CONTROL CABLES
H. CONTROL LEVERS
I. ELECTRIC POWER SUPPLY (12 VDC)
J. IMPACT RESISTANT PLATES
K. LADDER RUNG SUPPORT BAR
L. FIRST FLOOR TELESCOPIC GROUND ANCHOR. WITH FOOTPLATE
M. LADDER RUNG SUPPORT BAR RELEASE HANDLE
N. IMPACT RESISTANT BAR SPRINGS
O. LADDER RUNG SUPPORT BAR ANCHOR SPRINGS FIG. 6—Rear View
A. ENTRY TIP NOZZLE
B. ENTRY NOZZLE CONTROL PULLEY
C. FOG NOZZLE
D. FOG NOZZLE CONTROL PULLEY
E. PIPE/BODY SUPPORT PLATES
F. WATER SUPPLY PIPE
G. CONTROL CABLES
H. CONTROL LEVERS
I. ELECTRIC POWER SUPPLY (12 VDC)
J. IMPACT RESISTANT PLATES
K. LADDER RUNG SUPPORT BAR
L. FIRST FLOOR TELESCOPIC GROUND ANCHOR. WITH FOOTPLATE
M. LADDER RUNG SUPPORT BAR RELEASE HANDLE
N. IMPACT RESISTANT BAR SPRINGS
O. LADDER RUNG SUPPORT BAR ANCHOR SPRINGS
P. STATIONARY SUPPORT RETAINING CLIPS WITH RELEASE
Q. 90 DEGREE FEMALE SWIVEL
R. PRE-CONNECTED DOUBLE JACKET FIRE ATTACK HOSE
S. CONTROL LED LIGHTING BLUE FIG. 7—Front View
A. ENTRY TIP NOZZLE
B. ENTRY NOZZLE CONTROL PULLEY
C. FOG NOZZLE
D. FOG NOZZLE CONTROL PULLEY
E. PIPE/BODY SUPPORT PLATES
F. WATER SUPPLY PIPE
G. CONTROL CABLES
H. CONTROL LEVERS
I. ELECTRIC POWER SUPPLY (12 VDC)
J. IMPACT RESISTANT PLATES
K. LADDER RUNG SUPPORT BAR
L. FIRST FLOOR TELESCOPIC GROUND ANCHOR. WITH FOOTPLATE
M. LADDER RUNG SUPPORT BAR RELEASE HANDLE
N. IMPACT RESISTANT BAR SPRINGS
O. LADDER RUNG SUPPORT BAR ANCHOR SPRINGS
P. STATIONARY SUPPORT RETAINING CLIPS WITH RELEASE
Q. 90 DEGREE FEMALE SWIVEL
R. PRE-CONNECTED DOUBLE JACKET FIRE ATTACK HOSE FIG. 8—External Body Structures
A. HEAD BODY COVER
B. RESCUE PLATE AND TOP COVER
C. BOTTOM PLATE COVER FIG. 9—Graphic Depiction of Grantham Mechanical Ventilator in Use.

This figure illustrates the invention mounted at the top of a ladder in a window opening with the ventilating fog exiting the compartment toward the left and the fire extinguishing water spraying into the room toward the right.

What is claimed is:

1. A firefighting device for ventilating smoke and suppressing fire in a burning structure, the device comprising:

a nozzle assembly mounted to a ladder at a 90 degrees angle relative to the ladder, wherein the nozzle assembly is configured to be secured to a window of the burning structure, the nozzle assembly comprising:

an entry tip nozzle oriented toward a first direction pointing away from the ladder, wherein the entry tip nozzle is configured to provide a plurality of spinning narrow streams of water for suppressing fire inside the structure, wherein the entry tip nozzle further includes a forcible-entry mechanism, and a fog nozzle oriented toward a second direction opposite to the first direction, wherein the fog nozzle is directed toward the window from inside the burning structure and configured to spray water outwardly through the window, and wherein the fog nozzle is configured to ventilate smoke from the burning structure to improve visibility inside the structure;

a water supply pipe configured to supply water to the nozzle assembly, wherein the fog nozzle is fluidly connected to the water supply pipe via a substantially U-shaped pipe section, wherein the U-shaped pipe section extends upwardly from the water supply pipe;

a support plate attached to the water supply pipe and the U-shape pipe section; and a cover assembly comprising:

a bottom plate covering a bottom portion of the water supply pipe and the nozzle assembly, a top plate covering a top portion of nozzle assembly and the U-shape pipe section, and a rescue plate provided at a top portion of the water supply pipe, wherein the rescue plate provides a flat platform allowing firefighters to reach the ladder and escape the burning structure.

2. The device of claim 1, further comprising a ground anchor with a foot plate.

3. The device of claim 2, further comprising a water input connected to a double jacket fire hose.

4. The device of claim 3 is configured to adjust a flow rate and a spray pattern produced by the fog nozzle.

5. The device of claim 4, wherein an outlet of the fog nozzle is located three feet away from an opening of the window.

* * * * *